United States Patent [19]

Cotherman et al.

[11] Patent Number: 4,901,413

[45] Date of Patent: Feb. 20, 1990

[54] METHOD AND APPARATUS FOR ESTABLISHING MULTI-STAGE GAS SEPARATION UPSTREAM OF A SUBMERSIBLE PUMP

[75] Inventors: Robert D. Cotherman, Houston, Tex.; Keith F. Way, Traverse City, Mich.

[73] Assignee: Shell Western E & P Inc., Houston, Tex.

[21] Appl. No.: 275,245

[22] Filed: Nov. 22, 1988

[51] Int. Cl.[4] ..... B21D 53/00

[52] U.S. Cl. ..... 29/890.14; 29/401.1; 417/244

[58] Field of Search ..... 29/157 R, 401.1, 525.1; 417/244, 245, 246, 247, 257, 267, 382; 166/105.5

[56] References Cited

U.S. PATENT DOCUMENTS

| | | | |
|---|---|---|---|
| 1,639,734 | 8/1927 | Jones | 166/105.5 |
| 2,969,742 | 10/1961 | Arutunoff | 415/169.1 |
| 3,887,342 | 6/1975 | Bunnelle | 166/105.5 X |
| 4,067,665 | 1/1978 | Schwartzman | 417/245 |
| 4,088,459 | 5/1978 | Tuzson | 166/105.5 |
| 4,354,554 | 10/1982 | Calhoun et al. | 166/105.5 X |
| 4,360,320 | 11/1982 | Owen | 417/244 |
| 4,632,184 | 12/1986 | Renfroe, Jr. et al. | 166/105.5 |

OTHER PUBLICATIONS

Centrilift-Hughes Promotional Literature, 1985.

Pump Manufacturer's Drawing of a Single-Stage Gas Separator.

Pump Manufacturer'Drawing of a Single-Stage Reverse Flow Gas Separator.

Centrilift-Hughes Drawing of a Two-Stage Rotary Gas Separator.

*Primary Examiner*—Timothy V. Eley

[57] ABSTRACT

A method for constructing a multiple-stage gas separator assembly for downhole use upstream of a hydrocarbon producing submersible pump system is disclosed which has steps for forming a first-stage gas separator from a first conventional single-stage gas separator, connecting a coupling assembly to the first-stage gas separator at its downstream end, forming a second-stage gas separator from a second conventional single-stage gas separator by removing all lower flanges upstream of its fluid inlet, connecting the upstream end of the second-stage gas separator to the coupling assembly, and establishing a flow path from the first-stage liquid outlet to the second-stage inlet through the coupling assembly. A coupling assembly for joining first and second single-stage gas separators into a multiple-stage gas separator is also disclosed in which the coupling assembly has means for attaching to the downstream end of a first-stage gas separator, and a coupling housing defining a flow path between the liquid outlet of the first-stage gas separator and the fluid inlet of the second-stage gas separator. In an alternate embodiment, an adaptor is disclosed for inclusion into the coupling assembly which provides flow paths and a bushing for the second-stage gas separator formed from an alternate commercially available single-stage gas separator configuration.

8 Claims, 8 Drawing Sheets

FIG.10B
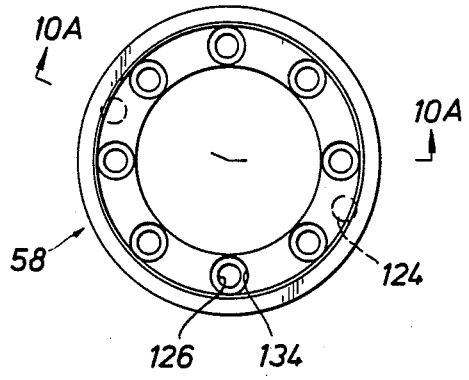
FIG.9A
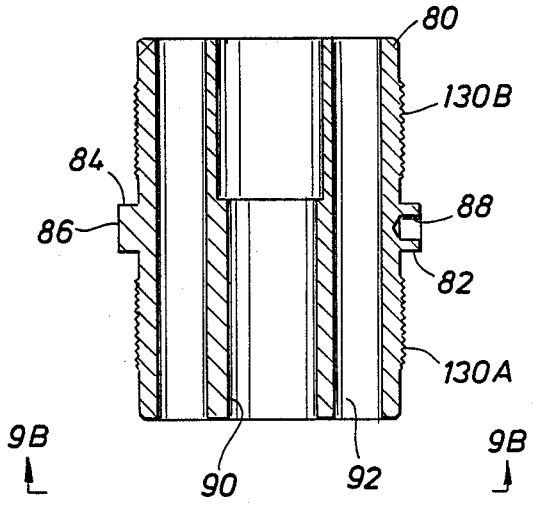
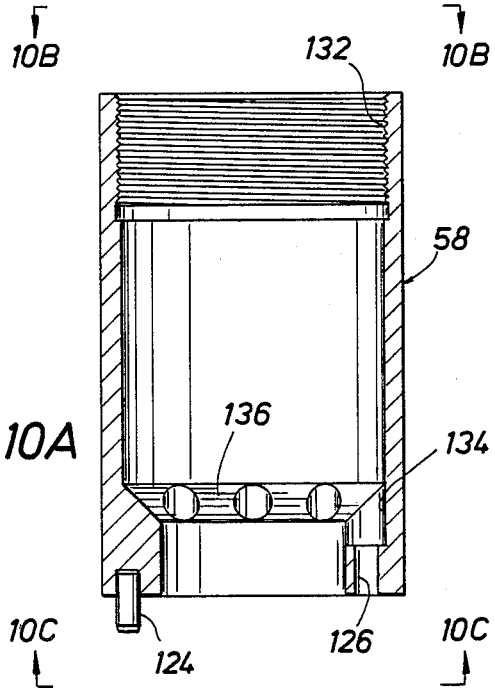
FIG.10A
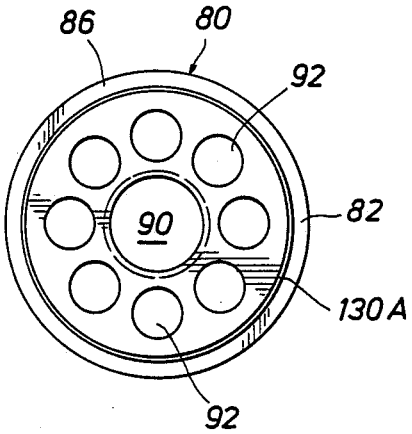
FIG.9B
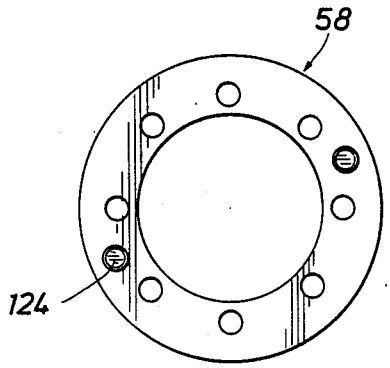
FIG.10C

METHOD AND APPARATUS FOR ESTABLISHING MULTI-STAGE GAS SEPARATION UPSTREAM OF A SUBMERSIBLE PUMP

BACKGROUND OF THE INVENTION

The present invention relates to multiple-stage gas separation in a submersible pump system for producing hydrocarbons from gassy wells. More particularly, the present invention relates to a method and apparatus for modifying and combining a plurality of commercially available single-stage gas separators into a high-efficiency multiple-stage gas separator for protecting a submersible pump system from gas lock.

Submersible pumps carried on the lower end of production tubing provide an economically attractive means to produce hydrocarbons under a variety of circumstances. However, such submersible pumps are susceptible to vapor or gas lock in environments having a high gas-liquid ratio. Gas lock is a type of pump failure brought on by an influx into the pump of substantially compressible fluids, i.e., the gaseous components of the production fluid. Once seized in gas lock, it may be difficult to circulate the gaseous component out of the pump to resume normal function. At best, this requires cessation of production to cycle the submersible pump. At worst, gas locking can result in failure of the submersible pump system requiring a trip of the production tubing to access the pump system. The trauma of gas lock stresses the components of the submersible pump and contributes to excessive wear and premature failure of both the pump and the motor, especially in combination with the excessive motor temperatures generated during gas locking. It does not take many preventable trips of the production tubing out of well bore to service a submersible pump or motor in order to substantially alter the economic considerations which otherwise favor submersible pump systems over alternatives for a specific application.

In the past, a single-stage gas separator has been deployed upstream of the pump in order to extend the range of submersible pump systems to formations having a gaseous component of the production fluids. While single-stage gas separators are helpful in limited ranges, gas lock continued to be a substantially limiting factor in the deployment of submersible pumps for production from gassy wells.

Applicants' co-pending application addresses a method and apparatus for high efficiency gas separation in which a submersible pump system operating in a high gas-liquid ratio well is protected from gas lock with multiple-stage gas separation which effectively separates the gaseous components of the produced hydrocarbons upstream of the pump and passes these gaseous components to the annulus between the production tubing and the casing. Thus, the fluid advancing to the submersible pump is substantially limited to the liquid components of the production fluid. However, establishing multiple-stage gas separation upstream of the pump in the severe dmensional constraints of the bore hole is a formidable problem. Further, it would be desirable to provide for combination of a plurality of existing single-stage gas separators into a multiple-stage gas separation as a method to provide an economical, immediate solution into practice, but conventional single-stage gas separators are not compatible for such combination.

SUMMARY OF THE INVENTION

It is therefore an object of the present invention to provide a method for combining single-stage gas separators into a multiple-stage gas separator assembly within the dimensional constraints of the bore hole.

Another object of the present invention is to provide a method for modifying commercially available single-stage gas separators for combination into a high efficiency gas separator suitable for use in high gas-liquid ratio wells.

Finally, it is an object of the present invention to provide a coupling member suitable for combining modified commercially available single-stage gas separators into a high efficiency multiple-stage gas separator suitable for use in high gas-liquid ratio wells.

Toward the fulfillment of these and other objects for constructing a multiple-stage gas separator assembly for downhole use upstream of a hydrocarbon producing submersible pump system, the method of the present invention comprises forming a first-stage gas separator from a first conventional single-stage gas separator, connecting a coupling assembly to the first-stage gas separator at its downstream end, forming a second-stage gas separator from a second conventional single-stage gas separator by removing all lower flanges upstream of its fluid inlet, connecting the upstream end of the second-stage gas separator to the coupling assembly, and establishing a flow path from the first-stage liquid outlet to the second-stage inlet through the coupling assembly.

In addition, a coupling assembly for joining first and second single-stage gas separators into a multiple-stage gas separator is provided by the present invention, said coupling assembly comprising means for attaching to the downstream end of a first-stage gas separator, means for attaching to the upstream end of the second-stage gas separator, and a coupling housing defining a flow path between the liquid outlet of the first-stage gas separator and the fluid inlet of the second-stage gas separator. In an alternate embodiment, an adaptor is disclosed for inclusion into the coupling assembly which provides flow paths and a bushing for the second-stage gas separator formed from an alternate commercially available single-stage gas separator configuration.

The multiple-stage gas separators constructed in acordance with the present invention provide economical, easily available protection to a submersible pump system for producing hydrocarbons from gassy oil wells which are subject to gas locking. Gaseous components are separated at each stage and expelled through the respective housings and into the annulus from gas outlets at each stage while the retained liquid components of the production fluid are presented to the pump, or to additional separation stages as necessary, through liquid outlets at the downstream end of each stage. The production fluid finally presented to the pump inlet is thereby substantially limited to the liquid components and means are provided in the pump for pumping this separated liquid component of the production fluid through a pump outlet and into the production tubing.

A BRIEF DESCRIPTION OF THE DRAWINGS

The above brief description as well as further objects, features, and advantages of the present invention will be more fully appreciated by reference to the following detailed description of the presently preferred, but nonetheless illustrative, embodiments of the present invention with reference to the accompanying drawings in which:

FIG. 9A is a longitudinal cross-sectional view of the adaptor of FIGS. 8B and 8C;

FIG. 9B is an end view of the adaptor of FIG. 9A as viewed from line 9B—9B illustrated in FIG. 9A;

FIG. 10A is a longitudinal cross-sectional view of the coupling of FIGS. 8B and 8C;

FIG. 10B is an end view of the top of the coupling of FIG. 10A as viewed from line 10B—10B in FIG. 10A;

FIG. 10C is an end view of the bottom of the coupling illustrated in FIG. 10A viewed from line 10C—10C of FIG. 10A;

A DETAILED DESCRIPTION OF THE PREFERRED EMBODIMENTS

Figure 1:
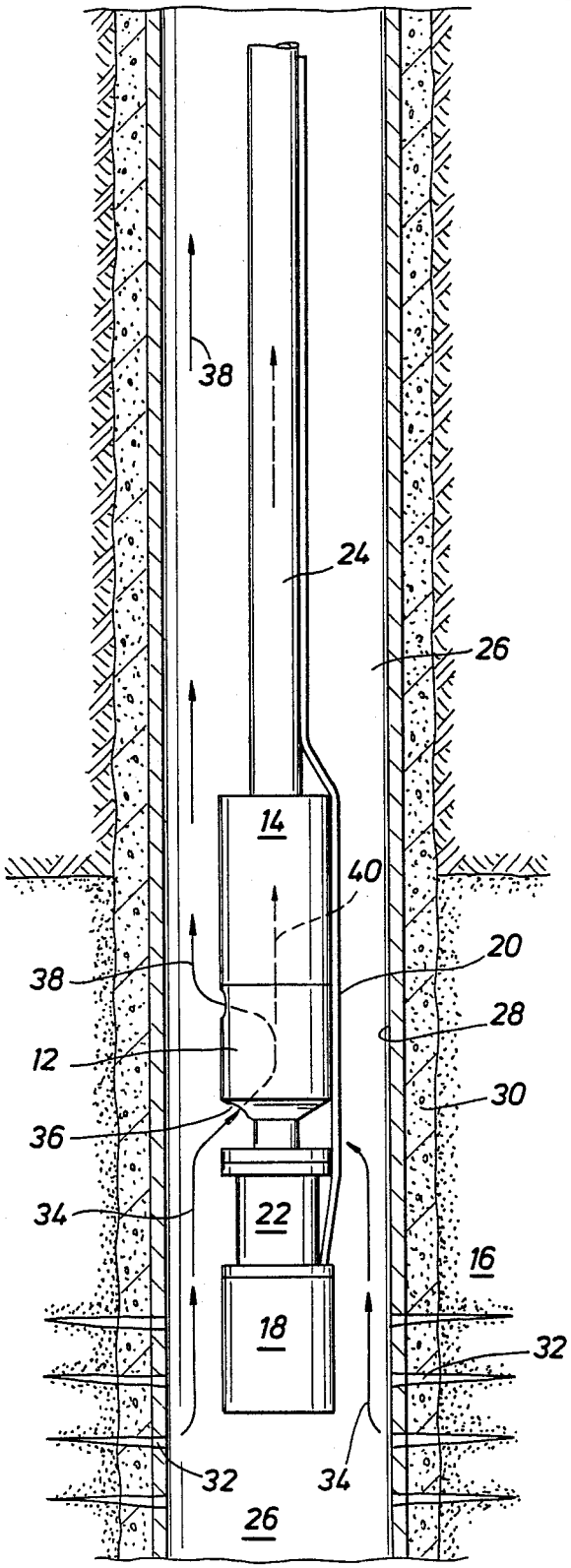
FIG.1 (PRIOR ART)
FIG. 1 is a cross-sectional view of a submersible pump system with a gas separator in accordance with the prior art.

FIG. 1 illustrates schematically the use of a single-stage gas separator 12 in conjunction with a submersible pump 14 for the production of oil from a gas-bearing formation 16. This prior art submersible pump system supplies power to a motor 18 through an electrical cable 20. Motor 18 is at the lowermost portion of the submersible pump system and passes a shaft (not shown) through a seal section 22 to drive single-stage gas separator 12 and ultimately submersible pump 14 downstream therefrom. The assembly of motor, seal section, single-stage gas separator, and pump is carried at the bottom of a string of production tubing 24 which is inserted into well bore 26 which is preferably completed with a casing 28 cemented in place with a cement 30 and providing access to the hydrocarbon-bearing formation 16 through a plurality of perforations 32. The production fluids, which are designated by arrows 34, flow into well bore 26 through perforations 32 and into single-stage gas separator 12 through a single-stage inlet 36. Means (not shown) for separating the liquid and gas components of the production fluid operate within the single-stage gas separator to separate some of the gaseous component 38 from production fluid 34 and advance a production fluid which is more nearly limited to liquid components 40 through pump 14 to be advanced up production tubing 24.

Figure 2:
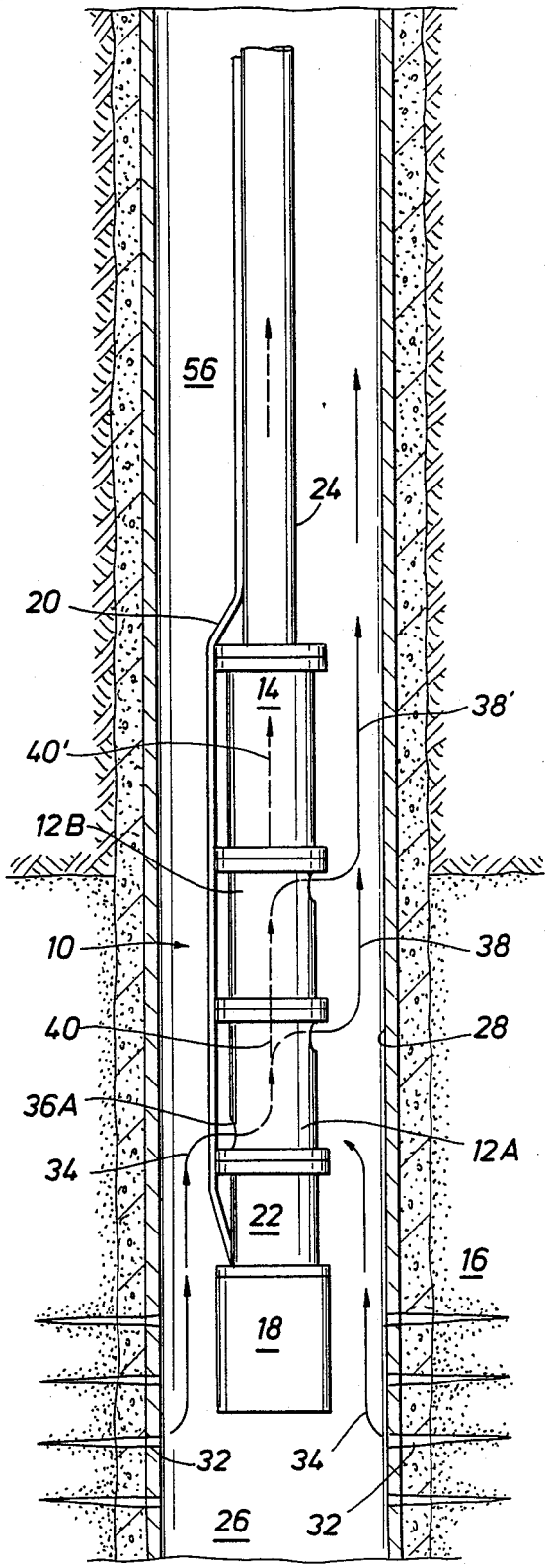
FIG. 2 is a simplified cross-sectional view of a submersible pump system having multi-stage gas separation.

FIG. 2 is a schematic illustration of submersible pump system 10 having a multiple-stage gas separator which, contrary to the conventional wisdom, successfully combines multiple-stage gas separation upstream of pump 14 in order to ensure that substantially only liquid components of the hydrocarbon production fluids 34 are passed into the pump.

At the time of the present invention, such single-stage gas separators as discussed above were thought so efficient that multiple stages were considered impractical. Certain gas-liquid ratio wells might be aided by a single-stage gas separator, but high gas-to-liquid ratio wells were just not considered candidates for submersible pump driven production. In accordance with this conventional wisdom, additional stages would throw out significant liquid components with the additional gas component separated and so starve the pump that it would sense an underloaded condition analogous to pump-off conditions and would therefore shut down. It has now been found that multiple-stage gas separation upstream of the submersible pump may significantly extend the range of the submersible pump systems into higher gas liquid ratios and that properly combined stages properly matched to reservoir conditions will not starve the pump.

As with the prior art submersible pump system illustrated in FIG. 1, submersible pump system 10 may be deployed at the lower end of production tubing 24 within well bore 26 which has been conventionally completed with a casing 28 cemented to formation 16 and communicating therewith through perforations 32. In the schematic illustration of FIG. 2, submersible pump system 10 is illustrated having a motor 18 which is provided power through an electrical cable 20. Motor 18 is preferably provided with a seal section 22 which passes the motor shaft (not shown) therethrough but isolates motor 18 from any contamination from production fluids 34 entering the well bore and ultimately advancing through downstream portions of submersible pump system 10. Two or more stages of gas separation, here first-stage gas separator 12A and second-stage gas separator 12B, separate the gassy oil produced into liquid and gaseous components. Production fluid 34 enters first-stage gas separator 12A at first-stage inlet 36A, separating the gaseous component 38 from the liquid component 40 and expelling the gaseous component to annulus 56. The initially-separated liquid component 40 contains a significant vapor content that retains the potential to vapor lock pump 14. Liquid component 40 passes to second-stage gas separator 12B where further gaseous components 38' are separated and a more substantially liquid phase component of the production fluid 40' is passed to pump 14 and thereby advanced up production tubing 24.

This use of sequential, staged gas separators substantially increases the efficiency of the gas separation and thereby extends the range of economic submersible pump operation in gassy oil well applications.

Figure 3A:
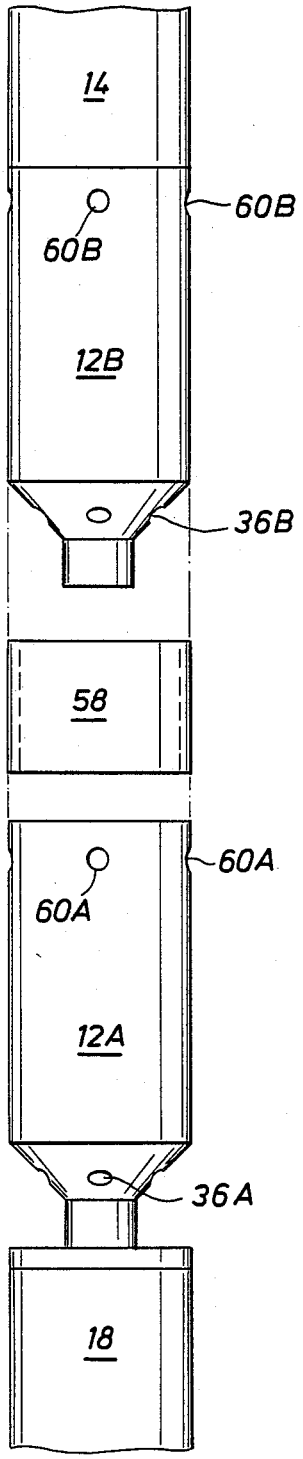
FIG. 3A is an exploded view of the components of a submersible pump system having a multiple-stage gas separator in accordance with an embodiment of the present invention.
Figure 3B:
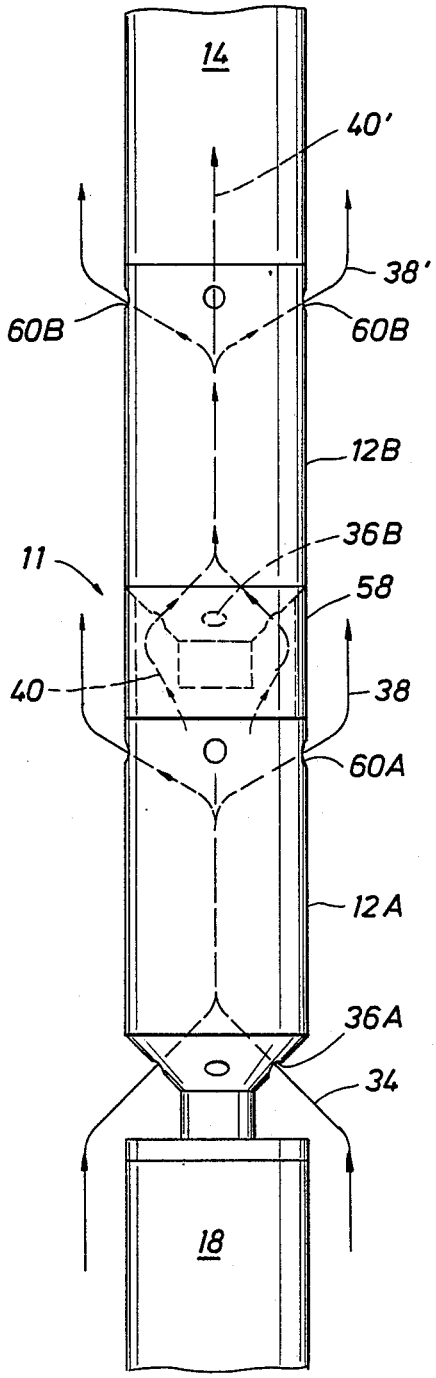
FIG. 3B is a side elevational view of the assembled components of FIG. 3B with an illustration of the flow paths established thereby.

FIGS. 3A and 3B introduce schematic illustrations of a preferred assembly of first-stage gas separator 12A and second-stage gas separator 12B into a multiple-stage gas separator through a coupling or coupling assembly 58. FIG. 3A is an exploded view of these components in a system in which no separate seal section 22 has been added over those seals provided in the housing of motor 18. FIG. 3B shows the assembled multiple-stage gas separator assembly 11 including the flow paths therethrough. Thus, the unprocessed production fluid 34 enters first-stage gas separator 12A through substantially radially oriented first-stage inlets 36A and is initially separated such that a first gaseous component 38 is eccentrically discharged through first-stage gas outlets 60A and initially separated liquid component 40 is concentrically advanced around the drive shaft (not shown) and through a flow path provided by coupling 58 to a plurality of substantially radial second-stage inlets 36B. Further separation within second-stage separator 12B separates further additional gaseous components 38' which are expelled through second-stage gas outlets 60B and advances substantially gas-free liquid component 40' to pump 14.

Figure 4:
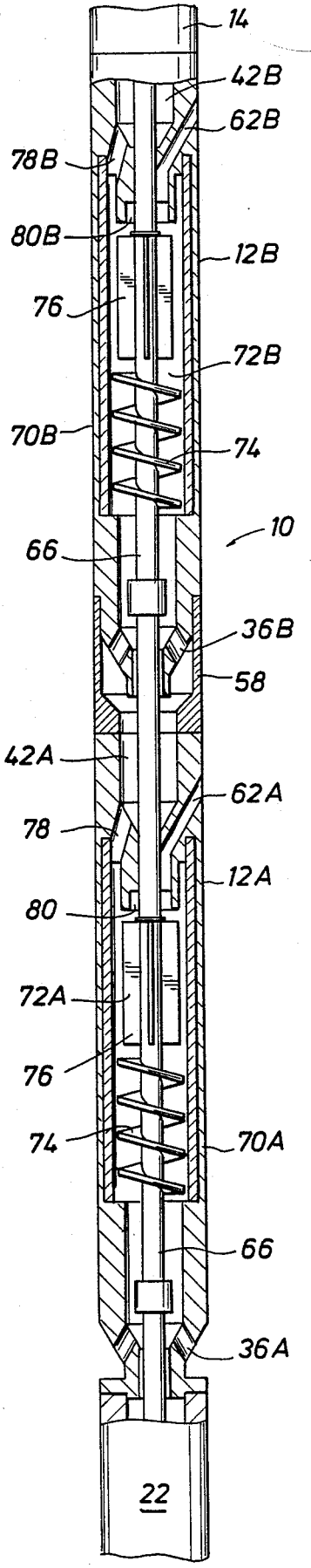
FIG. 4 is a cross-sectional view of a submersible pump system having a multiple-stage gas separator in accordance with an embodiment of the present invention.

FIG. 4 illustrates the internal components of a preferred embodiment of the multiple-stage gas separator 11 of a submersible pump system 10 with a cross-sectional illustration of first- and second-stage gas separators 12A and 12B, respectively, and coupling 58 therebetween. Shaft 66 proceeds from motor 18 (not shown in this figure) through seal section 22 and through the coupling to first-stage gas separator 12A. The seal section isolates the motor from production fluids which are otherwise in contact with shaft 66 within submersible pump system 10.

First-stage gas separator 12A has a first-stage housing 70A surrounding a primary means 72A for separating gas from the production fluid. Primary means 72A, in this embodiment, includes a feed screw 74 mounted on shaft 66 above first-stage inlets 36A and paddles 76 also mounted on shaft 66 downstream from feed screw 74. Feed screw 74 pulls the production fluid into first-stage housing 70A and drives the fluid into paddles 76 which then centrifically separate the heavier liquid components to a liquid channel 78 which leads to first-stage liquid outlet 42A. The lighter, gaseous components of the production fluid are collected in a central collection inlet 80 and directed to first-stage gas outlet 62A.

Shaft 66 continues through coupling 58 to drive secondary means for separating gas 72B of second-stage gas separator 12B within second-stage housing 70B. In this embodiment, the initially-processed liquid components from first-stage gas separator 12A are concentrically fed around shaft 66, through coupling 58, and into radially disposed second-stage inlets 36B. Similarly, these initially processed liquid components are drawn by a feed screw 74 to a plurality of paddles 76 which centrifically separate an additional gaseous component from the initially processed liquid component and expel this gaseous component through a central collection inlet 80B and a second-stage gas outlet 62B while feeding the substantially pure liquid phase production fluid through a liquid channel 78B to second-stage liquid outlet 42B. Additional stages of gas separator can be sequentially added with similar couplings as necessary until the production fluid forwarded to pump 14 is substantially limited to liquid phase components, thereby avoiding vapor lock in the submersible pump.

Figure 5:
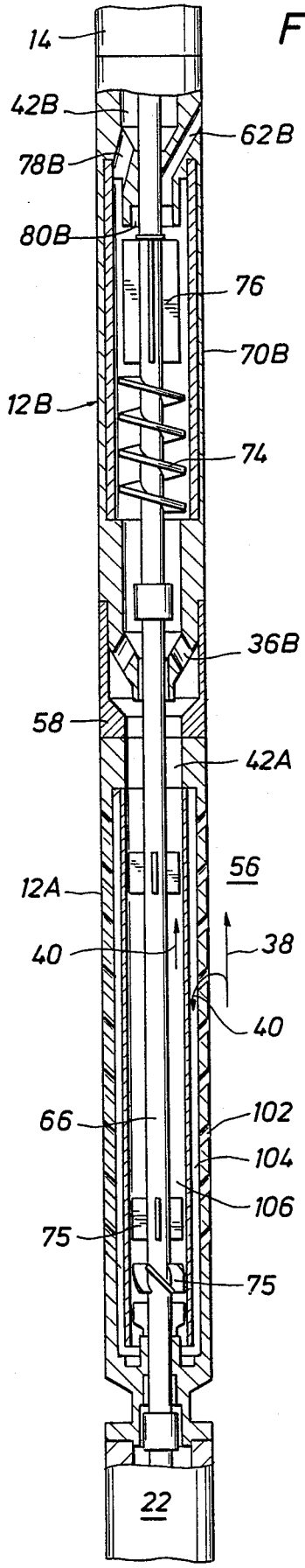
FIG. 5 is a cross-sectional view of a submersible pump system having an alternate embodiment of a multiple-stage gas separator in accordance with the present invention.

FIG. 5 is an alternate embodiment in which the first-stage gas separator 12A is a reverse-flow separator. Here the initial separation is undertaken with a high volume, low efficiency reverse flow separator. Such a separator operates by gravity, requiring the heavier liquid components 40 to counterflow from upward flow in annulus 56, through downwardly extending openings 102, and downwardly into an annular separation chamber 104 which opens into a central bore 106 at its lower end. There the flow of the liquid component 40 reverses and is carried through various feed screws and paddles 75 carried on shaft 66, out first-stage liquid outlet 42A and to second-stage inlet 36B through coupling 58. Second-stage gas separator 12B of FIG. 5A is substantially identical to the rotary type second-stage gas separator illustrated in FIG. 4.

Figure 6A:
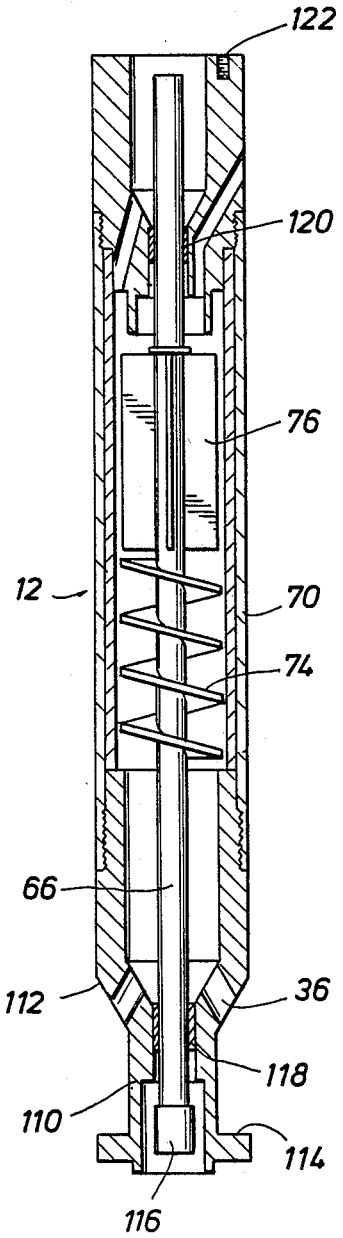
FIG. 6A is a longitudinal cross-sectional view of a commercially available single-stage gas separator.

FIGS. 6A–6C and 7A–7C illustrate a preferred method and apparatus for assembling a multiple-stage gas separator assembly for a submersible pump system from commercially available components with custom couplings and/or adaptors. FIG. 6A illustrates a single-stage gas separator 12 of a type presently marketed by Hughes Centrilift as Model FRSXINT. This cross-sectional view has been simplified for the purpose of illustration by deletion of an inducer stage and various other details which are well known in the art. In the preferred embodiment of the present invention, a first conventional single-stage gas separator is used with minor modification to form first-stage gas separator 12A illustrated in FIG. 6B, and a second conventional single-stage gas separator is used with more substantial modification, to form second-stage gas separator 12B.

Returning to FIG. 6A, housing 70 of single-stage gas separator 12 terminates at its inlet end in a narrow neck 110 having shoulders 112 through which single-stage inlets 36 radially open. Housing 70 is flaired at the top of shoulder 112 to substantially the maximum diameter allowable for the down hole assembly. An externally, radially protruding lower flange 114 is provided at the bottom of neck 110 to provide means for connecting to the seal section or motor of a conventional submersible pump system. The diameter of flange 114 similarly extends to substantially the diameter allowable for the down hole assembly. Shaft 66 extends through housing 70 beginning with a shaft coupling 116 at the lower terminal end below lower bushing 118 which rotatably secures shaft 66 within neck 110. Shaft 66 drives feed screw 74 and paddles 76 and rotatably engages upper bushings 120. The flow paths are substantially as described with respect to FIG. 4. The upper end of housing 70 axially receives bolts in threaded bolt-receiving means 122.

Figure 6B:
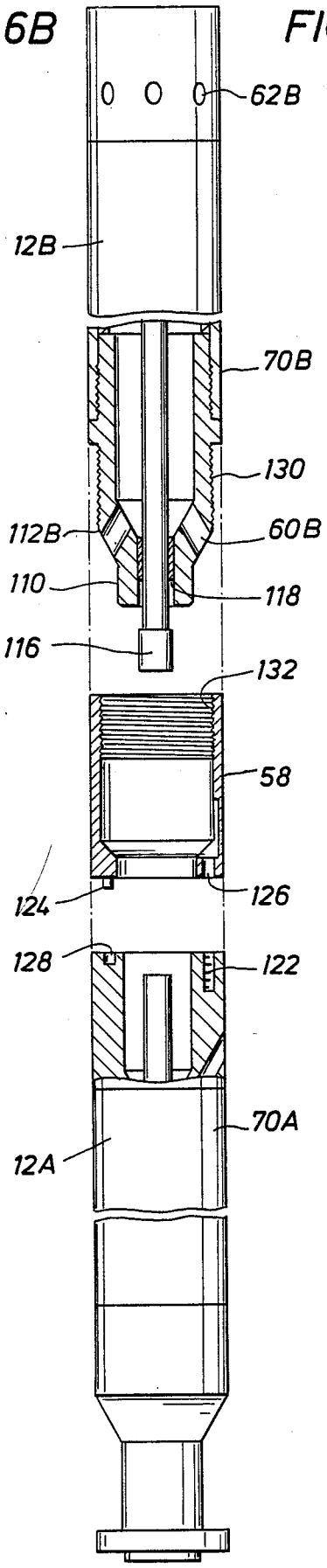
FIG. 6B is an exploded, partially cross-sectioned side elevational view of unassembled components of a submersible pump system having a multiple-stage gas separator in accordance with the present invention, including a modified second-stage gas separator.

FIG. 6B illustrates a preferred method for constructing a multiple-stage gas separator assembly in accordance with the present invention by modifying commercially available components. This example utilizes Hughes Centrilift rotary gas separators for both first-stage gas separator 12A and second-stage gas separator 12B as connected through a coupling 58. Coupling 58 is tapped on its lower surface to receive bolts to engage the threaded receiving means 122 presented on the upper surface of housing 70A of first-stage gas separator 12A. It is preferred that a key 124 be provided on coupling 58 and a corresponding receptacle 128 be added to the first-stage gas separator 12A to facilitate alignment of threaded bolt-receiving means 122 and 126.

Subsequent gas separation stages, here represented by second-stage gas separator 12B, may be formed from conventional single-stage gas separators by removing flange 114 below lower bushing 118. This reduces the outside diameter of the lower portion of the modified gas separator and allows coupling 58 to establish a flow path from the first-stage liquid outlet to the second-stage fluid inlet by providing a fluid passage around the lower end of second-stage gas separator 12B at neck 110 and thereby providing access to second-stage inlet 60B presented radially through shoulders 112. Means are provided for attaching the coupling assembly to the upstream end of the second-stage inlet, here by threaded engagement. The lower portion of the outside of housing 70B above shoulders 112B is threaded for sealing engagement with the internally-threaded coupling 58 with threaded regions denoted 130 and 132, respectively. It is further preferred that second-stage inlets 60B be somewhat enlarged to facilitate the flow into the second-stage gas separator 12B. Compare second-stage gas separator 12B with the unmodified single-stage gas separator 12 of FIG. 6A.

Figure 6C:
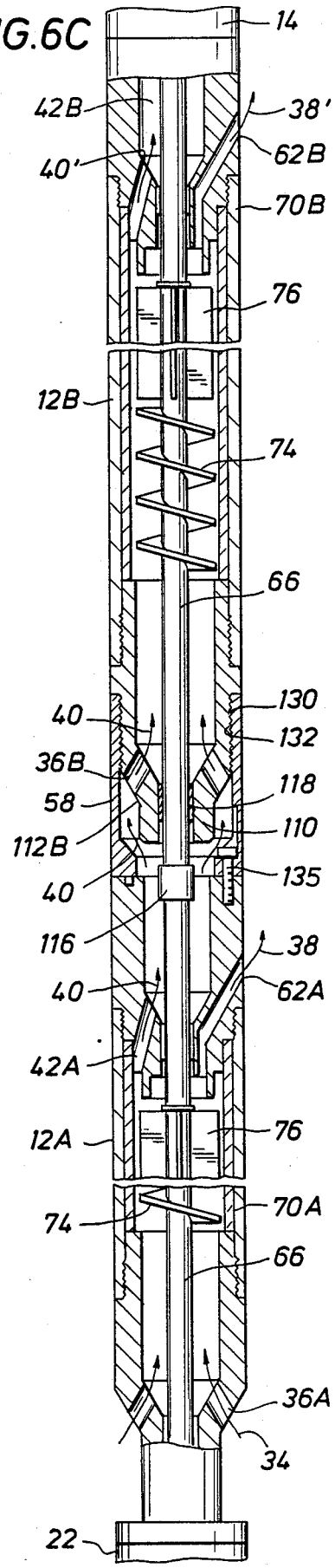
FIG. 6C is a longitudinal cross-sectional view of a submersible pump system having a multiple-stage gas separator in accordance with the present invention.

FIG. 6C illustrates the flow paths of assembled combined first and second gas separators 12A and 12B. Here, shaft coupling 116 joins the portion of the shaft 66 in first-stage gas separator 12A with the portion of the shaft running through the second-stage gas separator 12B. Further, the connection of the first-stage gas separator and the second-stage gas separator through coupler 58 is illustrated with bolt 135 at this cross-section and the engagement of the external threads 130 of second-stage gas separator 12B with the internal threads 132 of coupling 58 is illustrated. Thus, gassy production fluid 34 enters first-stage gas separator 12A at first-stage inlets 36A through housing 70A as drawn by feed screw 74 which is driven by shaft 66 as are paddles 76 which centrifically separate the heavier liquid components 40 from gaseous components 38 of the production fluid, passing the gaseous components through first-stage gas outlet 62A and passing the liquid component through first-stage liquid outlet 42A around shaft 66. The initially-processed liquid component then passes to coupling 58 where it flows around neck 110 which secures shaft 66 within lower bushings 118 of the second-stage gas separator 12B. This flow then annularly progresses past neck 110 and into second-stage inlets 36B through shoulders 112B. The partially-separated liquid component is then drawn and driven with another feed screw 74 and separated with additional paddles 76, passing additional gaseous components 38' through housing 70B at second-stage gas outlets 62B and advancing the further refined liquid component 40' through second-stage liquid outlet 42B, and so on through successive stages, until a liquid component 40' which is substantially free of vapor components is presented to submersible pump 14.

Figure 7B:
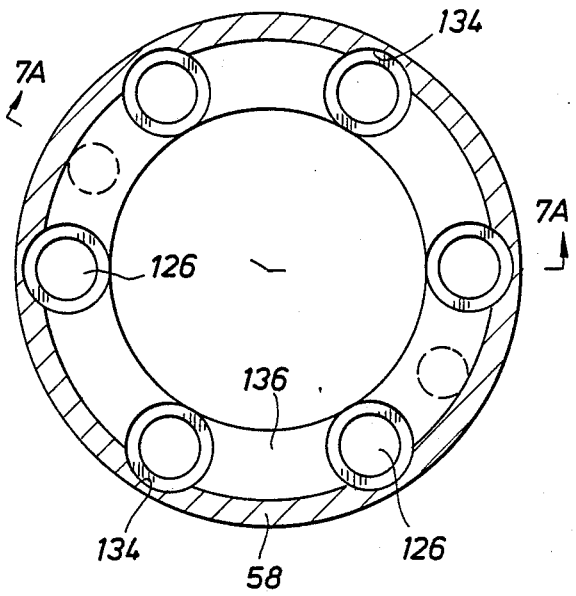
FIG. 7B is a cross-sectional view of a coupling in accordance with the present invention taken at line 7B—7B of FIG. 7A.
Figure 7A:
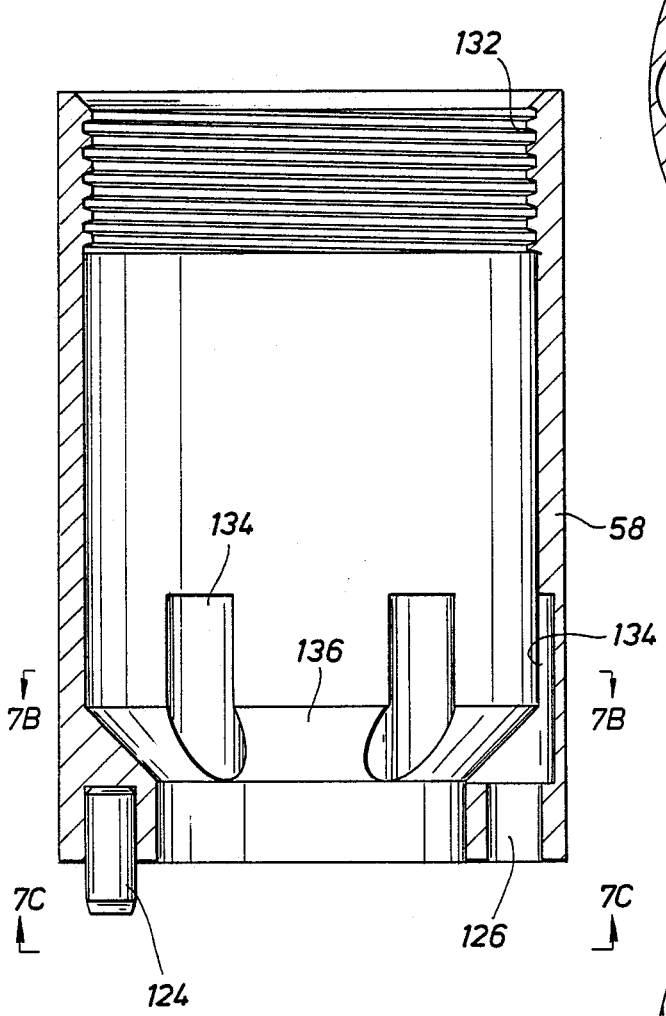
FIG. 7A is a longitudinal cross-sectional view detailing the coupling of FIGS. 6B and 6C.
Figure 7C:
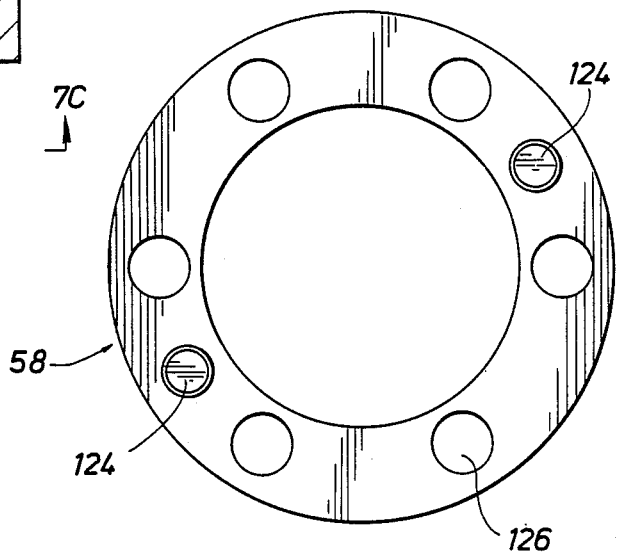
FIG. 7C is an end view of the coupling of FIG. 7A taken from line 7C—7C in FIG. 7A.

FIGS. 7A through 7C detail the coupling assembly of this embodiment, here represented by coupling 58 which is designed to connect a second-stage gas separator 12B modified in accordance with FIG. 6B with a first-stage gas separator 12A in order to facilitate use of commercially available rotary gas separators similar of the type exemplified by Hughes Centrilift Model FPAINT or FRSXINT.

Cross-sectional view 7A is skewed as designated in FIG. 7B in order to facilitate illustration of a key 124 and a bolt or screw receiving means 126 in the same illustration. Note recesses 134 to facilitate access to screw receiving means 126 within first conical shoulder 136 which leads from first-stage liquid outlet 42A to the annular space which ultimately provides access to a radially disposed second-stage inlets 60B. (See FIG. 6C.) Returning to the bottom view of the coupler in FIG. 7C, note the means for attaching the coupling assembly to the downstream end of the first-stage gas separator provided here by the downwardly disposed keys 124 to aid alignment of bolt receiving means 126 with threaded screw receiving means 122 carried on first-stage gas separator 12A. (See also FIG. 6C.)

FIGS. 8A–8C, 9A–9B, and 10A–10C illustrate an alternative method for assembling a submersible pump system from commercially available components with custom couplings and/or adaptors.

Figure 8A:
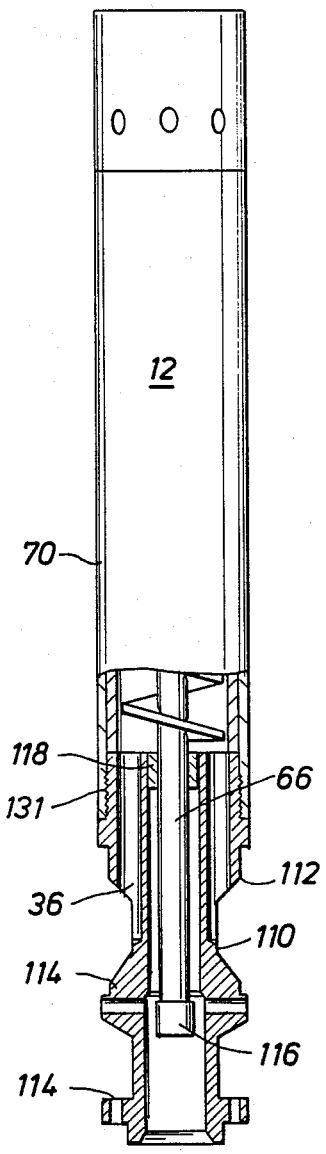
FIG.8A (PRIOR ART)
FIG. 8A is a partially cross-sectioned side view of an alternate commercially available single-stage gas separator.

FIG. 8A illustrates a single-stage gas separator 12 of a type presently marketed by REDA as model KGS. This cross-sectional view has been simplified for the purpose of illustration by deletion of various details which are well known in the art or previously discussed. In this alternate embodiment of the present invention, a single-stage gas separator is used with minor modification as first-stage gas separator 12A illustrated in FIG. 8B, and with more substantial modification, as second-stage gas separator 12B.

Returning to FIG. 8A, housing 70 of single-stage gas separator 12 terminates at its inlet end in a narrow neck 110 having shoulders 112 through which single-stage inlets 36 radially open. Housing 70 is flaired at the top of shoulder 112 to substantially the maximum diameter allowable for the down hole assembly. A pair of flanges 114 are provided below neck 110, each extends to substantially the maximum diameter allowed by the size of the completed borehole. Lower bushing 118 for shaft 66 is presented above upper flange 114. The lowermost flange provides means for connecting to the seal section or motor of a conventional submersible pump system. The means for separating the gaseous component from the liquid component of the production fluid and the flow paths are substantially as described with respect to the alternate conventional single-stage gas separator of FIG. 6A.

Figure 8B:
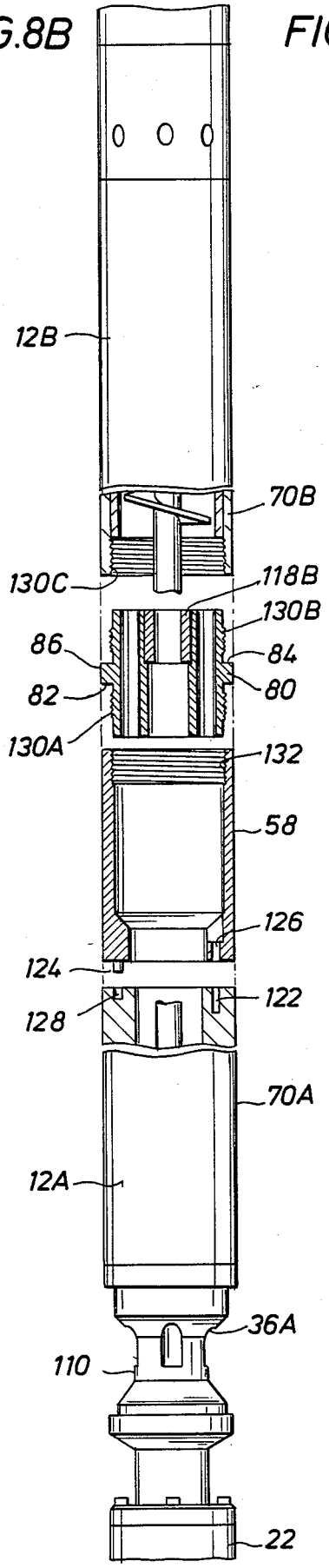
FIG. 8B is an exploded, partially cross-sectioned view of unassembled components of a submersible pump system having a multiple-stage gas separator in accordance with an alternate embodiment of the present invention, including a modified second-stage gas separator.

FIG. 8B illustrates this alternate method for assembling a submersible pump system in accordance with the present invention by modifying commercially available components. This example utilizes REDA rotary gas separators such as model KGS for both first-stage gas separator 12A and second-stage gas separator 12B as connected through a coupling 58. In the preferred embodiment of this alternate method coupling assembly 59 includes a coupling member 58 and an adaptor 80. Coupling member 58 is provided with a means for attaching to the first-stage gas separator. Here it is also preferred that the coupling member be tapped on its lower surface to receive bolts to engage the threaded bolt receiving means 122 presented on the upper surface of housing 70A of first-stage gas separator 12A. It is also preferred that a key 124 and corresponding receptacle 128 be provided on coupling 58 and be added to first-stage gas separator 12A, respectively, to facilitate alignment of threaded bolt-receiving means 122 and 126.

Subsequent gas separation stages, here represented by second-stage gas separator 12B, may be formed from a single-stage gas separator of this type by removing flanges 114 by breaking out the threaded connection 131 which also removes inlets 36 and bushing 118. (See FIG. 8A.) A replacement for bushing 118 is provided to second-stage gas separator 12B by an adaptor 80. This reduces the outside diameter of the lower portion of the modified gas separator and allows coupling member 58 and adaptor 80 (together coupling assembly 59) to establish a flow path or fluid passage from first-stage liquid outlet 42A to second-stage inlet 37 provided by the adaptor. (See FIG. 8C.)

Figure 8C:
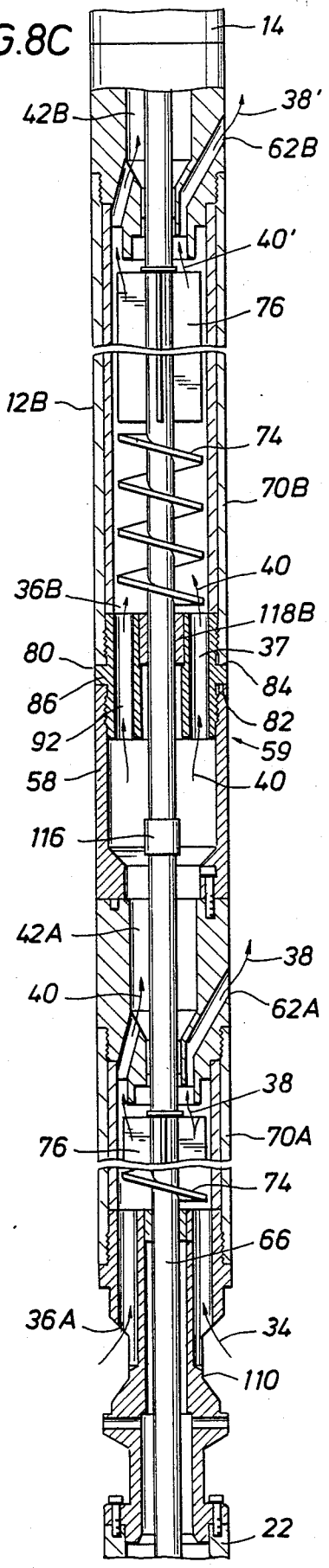
FIG. 8C is a longitudinal cross-sectional view of a submersible pump system having a multiple-stage gas separator in accordance with an alternate embodiment of the present invention.

In this embodiment, coupling member 58 is bolted to the top of first-stage gas separator 12A in the same manner as in the preceding example of FIGS. 8B and 8C. Similarly, the inside circumference of coupling member 58 presents threaded region 132. However, threaded region 132 matingly receives a lower exterior region 130A of an adaptor 80. Adaptor 80 screws into coupling member 58 until a lower adaptor shoulder 82 of a ring 86 seats against the coupling member.

In this embodiment, means for attaching the coupling assembly to the second-stage gas separator are provided by an upper exterior threaded region 130B of adaptor 80 which is matingly received within an interior circumferential threaded region 130C of second-stage gas separator 12B. Adaptor 80 screws into second-stage gas separator 12B until an upper adaptor shoulder 84 of ring 86 engages second-stage gas separator housing 70B.

FIGS. 9A and 9B detail adaptor 80, illustrating lower exterior threaded region 130A separated from upper threaded region 130B by ring 86 which presents lower and upper adaptor shoulders 82 and 84. The circumference of ring 86 is tapped with a plurality of recesses 88 to accept a wrench for make-up and breakdown operations.

Adaptor 80 defines a central shaft cavity 90 which is surrounded by a plurality of axial flow passages 92 within the adaptor housing. Central shaft cavity 90 is adapted to receive a lower bushing 118B. (See FIGS. 8B and 8C.)

FIGS. 10A–10C illustrate coupling member 58 of this alternate embodiment. In comparison with the coupling assembly of FIGS. 7A–7C, note that recesses 134 and conical shoulders 136 need not extend into the walls of the coupling. The axial flow passages 92 of adaptor 80 receive flow of the liquid component directly and it is not necessary for the coupling assembly to provide a flow path around neck 110 for access into the second-stage gas separator. Thus, the interior diameter of the coupling assembly becomes less critical in this embodiment. In other respects, the coupling assemblies of these alternate embodiments are substantially similar aside from the addition of the adaptor.

FIG. 8C illustrates the flow paths of assembled combined first- and second-stage gas separators 12A and 12B in the alternate embodiment. Gassy production fluid 34 enters first-stage gas separator 12A at first-stage inlets 36A through housing 70A as drawn by feed screw 74, which is driven by shaft 66 as are paddles 76 which centrifically separate the heavier liquid components 40 from gaseous components 38 of the production fluid, passing the gaseous components through first-stage gas outlet 62A and passing liquid components through first-stage liquid outlet 42A around shaft 66. The initially processed liquid component then passes to coupling 58 and then into axial flow passages 92 of adaptor 80 to feed directly into second-stage gas separator 12B as drawn by a further feed screw 74. Again, paddles 76 serves to centrifically separate a further gaseous component 38′ from a substantially liquid component 40′, passing gaseous component 38′ through gas outlet 62B and passing the substantially pure liquid component 40′ of the production fluid through liquid outlet 42B to pump 14.

EXAMPLE

Figure 11A:
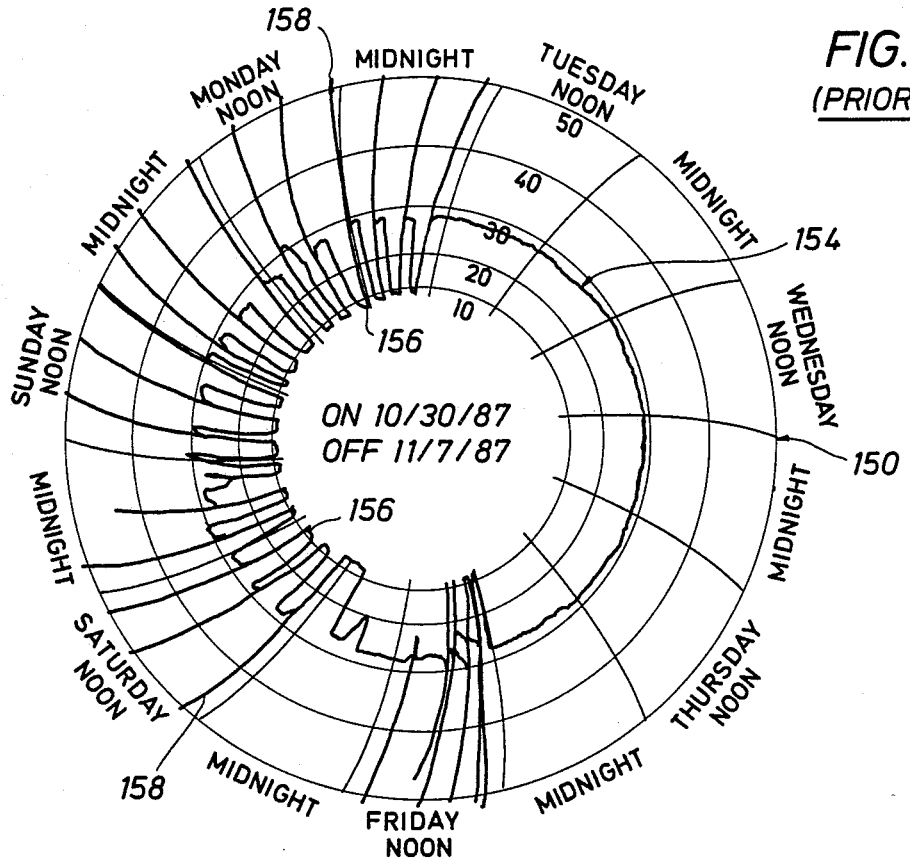
FIG. 11A (PRIOR ART)
FIG. 11A is a polar plot of amps/time for the current drawn by the motor of a submersible pump system having a single-stage separator in accordance with the prior art.
Figure 11B:
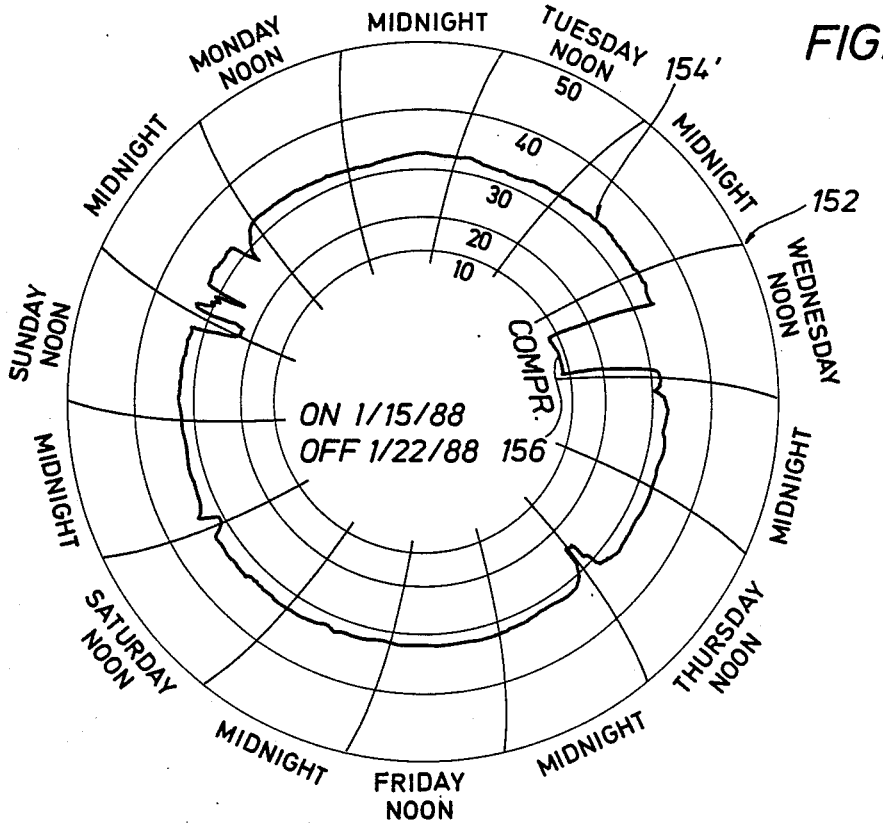
FIG. 11B is a polar plot of amps/time for the current drawn by the motor of a submersible pump system in accordance with the present invention.

FIGS. 11A and 11B are amp charts documenting test data comparing conventional single-stage gas separation with multiple-stage gas separation in accordance with the present invention. See charts 150 and 152, respectively. Both amp charts are from a gassy oil well under production by the Applicants. The conventional single-stage gas separator data was taken during the week of Oct. 30 to Nov. 7, 1987 and the multiple-stage gas separation data, here first- and second-stage separation, was taken the week of Jan. 15, 1988 to Jan. 22, 1988.

Referring to amp chart 150 of FIG. 11A, line or trace 154 indicates the current drawn by the motor in amperes and time with a polar graph presentation. Cycling in response to gas lock in the submersible pump is indicated by a dramatic decrease in the current drawn by the motor as gas lock initiates as shown by valleys 156 in trace 154. Valleys 156 are followed by a spike of high current usage upon resumption of pump action as the motor must overcome sticking and/or inertia of the pump and motor. The high number of peaks and valleys in trace 154 demonstrates extensive cycling of the submersible pump system required despite the presence of the conventional single-stage separator.

The period of relatively uninterrupted operation in amp chart 150 is thought to be a result of the slug flow of the reservoir producing during that period an unusually low gas-to-liquid ratio.

Contrast amp chart 150 of FIG. 11A with amp chart 152 of FIG. 11B. Amp chart 152 provides trace 154′ having only one cut-off point at valley 156 which was a result of an unrelated compressor failure, not the result of gas lock. The fact that this second test was initiated following a relatively high gas-to-liquid ratio and since continued monitoring of the well in multi-stage gas separation continued to produce similar results, demonstrate that the improvement is not an apparition caused by a favorable gas-to-liquid ratio flow from the reservoir during the test period.

Thus, cycling was reduced from 6 to 0 cycles per day with a resulting production increase from 85 barrels of oil, 234 barrels of water, and 99 MCFD of gas produced with single-stage separation to 154 barrels of oils plus 475 barrels of water plus 130 MCFD.

Thus, the present invention provides a submersible pump system and method for producing gassy wells which will effectively protect the pump system from vapor lock by multiple-staged separation of gaseous components to the annulus upstream of the pump. Further, alternate embodiments are disclosed for modification of existing single-stage separators to a form compatible with multiple-stage gas separation and specific adaptors and coupling elements are disclosed for joining the modified gas separators.

Other modifications, changes, and substitutions are intended in the foregoing disclosure and in some instances, some features of the invention will be employed without a corresponding use of other features. Accordingly, it is appropriate that the appended claims be construed broadly and in a manner consistent with the spirit and scope of the invention herein.

What is claimed is:

1. A method for constructing a multiple-stage separator assembly for downhole use upstream of a submersible pump system deployed for production from a high gas-to-liquid ratio reservoir, said method comprising:

forming a first-stage gas separator from a first conventional single-stage gas separator;

connecting a coupling assembly to the first-stage gas separator at a downstream end thereof at a position to receive an initially processed liquid component from a first-stage liquid outlet;

forming a second-stage gas separator from a second conventional single-stage gas separator having at least one exteriorally, radially protruding lower flange by removing each said which is upstream of a fluid inlet of the second conventional single-stage gas separator;

connecting the upstream end of the second-stage gas separator to the coupling assembly; and establishing a flow path from the first-stage liquid outlet to the second-stage inlet through the coupling.

2. A method of constructing a multiple-stage gas separator assembly in accordance with claim 1 wherein removing the lower flanges in forming the second-stage gas separator comprises cutting off a lower portion of a second-stage housing through a reduced diameter neck below the fluid inlet of the second conventional single-stage gas separator.

3. A method of constructing a multiple-stage gas separator assembly in accordance with claim 2 wherein forming the second-stage gas separator further comprises cutting threads on the exterior circumference of the second-stage housing downstream of the fluid inlet.

4. A method of constructing a multiple-stage gas separator assembly in accordance with claim 1 wherein removing all exteriorally, radially protruding lower flanges in forming the second-stage gas separator comprises breaking out a threaded connection of the lower portion of the second-stage housing, including a lower bushing and a fluid inlet as well as the lower flanges; and wherein connecting the upstream end of the second-stage gas separator to the coupling assembly further comprises replacing the lower bushing by mounting a bushing into a central cavity surrounded by a plurality of axial flow paths within an adaptor and joining the adaptor into the coupling assembly.

5. A method of constructing a multiple-stage gas separator assembly in accordance with claim 1 wherein connecting a coupling assembly to the downstream end of the first-stage gas separator further comprises:

aligning and engaging one or more keys on the bottom of the coupling with corresponding receptacles on the top of the first-stage gas separator; and bolting the coupling assembly to the first-stage gas separator with bolts passing through the bottom of the coupling assembly and into threaded engagement in the top of the first-stage gas separator.

6. A method of constructing a multiple-stage gas separator assembly in accordance with claim 1 wherein connecting the upstream end of the second-stage gas separator to the coupling assembly comprises securing in threaded engagement an internal circumferential thread of the coupling assembly with an external circumferential thread on the second-stage gas separator.

7. A coupling assembly for joining two gas separators into a multiple-stage gas separator assembly having a first and a second-stage gas separator, said first and second-stage gas separators each being of a type having a fluid inlet at an upstream end, a liquid outlet at a downstream end, and a gas outlet through the housing, said coupling assembly comprising:

means for attaching to the downstream end of a first-stage gas separator;

means for attaching to the upstream of second-stage gas separator; and a coupling housing defining a flow path between the liquid outlet of the first-stage gas separator and the fluid inlet of the second-stage gas separator;

a coupling member; and an adaptor, comprising:

an adaptor housing having externally circumferentially threaded region on both its upstream and downstream ends;

a plurality of axial passages within the adaptor housing;

an axially disposed central shaft cavity surrounded by the axial passageway; and a shaft receiving bushing seated within the central shaft cavity.

8. A coupling assembly in accordance with claim 7 wherein the adaptor further comprises a circumferential ring between the threaded regions on the upstream and downstream ends of the adaptor, said ring providing an upper shoulder and a lower shoulder which engage the second-stage gas separator and the coupling member, respectively.

* * * * *